US006565317B2

(12) United States Patent
Beeck et al.

(10) Patent No.: US 6,565,317 B2
(45) Date of Patent: May 20, 2003

(54) PLATELIKE PROJECTING COMPONENT PORTION OF A GAS TURBINE

(75) Inventors: Alexander Beeck, Kuessaberg (DE); Christoph Nagler, Zuerich (CH); Mark Richter, Baden (CH); Klaus Semmler, Dachau (DE); Lothar Schneider, Waldshut-Tiengen (DE); Joerg Stengele, Niederrohrdorf (CH)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/820,679

(22) Filed: Mar. 30, 2001

(65) Prior Publication Data

US 2001/0036407 A1 Nov. 1, 2001

(30) Foreign Application Priority Data

Mar. 31, 2000 (DE) ..... 100 16 081

(51) Int. Cl.[7] ..... F01D 5/18

(52) U.S. Cl. ..... 416/97 R

(58) Field of Search ..... 415/115, 116; 416/96 R, 96 A, 97 R, 95, 193 A; 165/168, 169

*Primary Examiner*—Edward K. Look
*Assistant Examiner*—Kimya N McCoy
(74) *Attorney, Agent, or Firm*—Burns, Doane, Swecker & Mathis, L.L.P.

(57) ABSTRACT

A platelike projecting component portion of a component used in gas turbines or other similar applications includes a surface upon which hot gas acts and cooling bores through which a cooling medium is capable of flowing. Effective cooling is achieved by providing at least one plenum assigned solely to the component portion. The plenum is arranged so as to be directly adjacent to the surface upon which hot gas acts and through which the cooling medium is capable of flowing to provide convective heat transfer. The cooling bores are designed as blow-out orifices which emanate from the plenum and issue the cooling medium onto the surface upon which hot gas acts, thereby forming a cooling film.

8 Claims, 5 Drawing Sheets

PLATELIKE PROJECTING COMPONENT PORTION OF A GAS TURBINE

This application claims priority under 35 U.S.C. §119 and/or 365 to Appln. No. 100 16 081.6 filed in Germany on Mar. 31, 2001; the entire content of which is hereby incorporated by reference.

BACKGROUND OF THE INVENTION

1. Field of the Invention

The invention relates to a platelike projecting component portion of a gas turbine, and more particularly, a platelike projecting component portion with a surface upon which hot gas acts and with cooling bores through which a cooling medium is capable of flowing.

2. Related Art

Component portions of components used in gas turbines are often encountered where an overhanging region is provided for various manufacturing reasons on a main component, such as, for example, on blades and fastening elements, on sealing elements that are to be mounted, and between two adjacent components. Overhanging component portions of this kind present problems, especially in regions which are subjected to high thermal load and in which hot gas acts upon the surface. It is often necessary to provide cooling for these overhanging component portions.

EP 0 911 486 A2 discloses a cooled blade of a gas turbine, in which overhanging regions in the form of platelike projecting component portions are mounted in front of and behind the blade root in the axial direction, in order to ensure an overlap in the hub region with the adjacent blade root regions of rotor blades. Cooling bores are provided for cooling these platelike projecting component portions, with cooling air flowing through the cooling bores to provide convective heat transfer. The cooling bores run, for example, in the front overhanging component portion in the circumferential direction and are fed from the main cooling-air supply. As a result of the high thermal load in this region, turbulence generators are additionally present in the cooling bores in order to improve the heat transmission.

The rear overhanging component portion has a multiplicity of axially running cooling bores which are likewise fed from the main cooling-air supply. The cooling bores issue axially at the end of the component portion, so that the cooling medium, after flowing through the cooling ducts, emerges into the hot-gas stream.

Both component portions have in common the fact that the surface upon which the hot gas acts is cooled purely convectively. One disadvantage of this is that a very large amount of cooling air has to be expended in order to achieve the necessary cooling effect. This results in an impairment of overall efficiency and makes it necessary to employ costly materials resistant to high temperature.

The invention attempts to avoid the disadvantages described above. In accordance with an embodiment of the invention, a platelike projecting component portion of a gas turbine component is provided, which allows a more effective cooling of the surface upon which hot gas acts. The component therefore has an increased useful life, at the same time with a reduced cooling-air requirement.

In accordance with an embodiment of the invention, a platelike projecting component portion includes a plenum which is assigned solely to the component portion, so that optimum cooling of the surface upon which hot gas acts becomes possible. The plenum is arranged to be directly adjacent to the surface to be cooled and has the cooling medium flowing through it to provide convective heat transfer. Furthermore, the cooling bores are designed as blow-out orifices which emanate from the plenum and issue the cooling medium onto the surface upon which hot gas acts. It is thus possible to implement extremely effective film cooling on the surface upon which hot gas acts, while the coolant consumption can be kept extremely low. The reason is that the cooling air first flows through the region to be cooled and provides convective heat transfer, and then by being blown out along the surface exposed to hot gas, the cooling air also forms a highly effective cooling film.

Although, in principle, there is broad freedom of design as regards the configuration of the plenum, it has proved advantageous if a single continuous plenum is provided, which passes essentially completely through the component portion. In this way, the surface upon which hot gas acts is cooled uniformly and without local interruption caused, for example, by intermediate walls, with the result that a greatly improved cooling effect can be implemented.

A series of preferred embodiments according to the invention provide simple and cost-effective implementations of this cooling concept. The choice of the process for optimizing the shape of the plenum depends mainly on the method of producing the actual component on which the platelike projecting portion is to be provided. Other important factors are the geometry to be implemented and the manufacturing prerequisites.

In the case of turbine blade overhangs manufactured according to the invention, the plenum can be shaped conjointly during shaping of the component by the casting method. This is possible, as a rule, without much additional outlay, since after removal from the casting mold the plenum has already been formed, and subsequent machining is not required.

As a rule, a multipart core is used, in order to implement the desired geometry of the plenum. If appropriate, lateral perforations for positioning the core may be necessary, which can be closed subsequently after the shaping process.

In an alternative embodiment, the plenum can be formed by means of a cavity in the component portion that is open, for example, opposite the surface to be cooled, and can therefore be closed by means of a cover that is subsequently mounted. This alternative avoids the need for providing a core to form the plenum. The advantage of this variant is improved flexibility in the design of the geometry of the plenum. The cover used to close the cavity in the component portion can be mounted by means of cost-effective connection methods, such as, for example, soldering or welding.

Finally, it is also possible to produce both the plenum and the blow-out orifices by means of the Electrical Discharge Machining (EDM) method. This method allows the shape, size and arrangement of the blow-out orifices to be selected freely and implemented with the highest possible precision. Also, the plenum can be manufactured using this method. Lateral outflow orifices, such as are necessary for producing the plenum, may remain completely or partially open as additional blow-out orifices, depending on the cooling requirements. Otherwise, the lateral outflow orifices that are not needed can be closed after the shaping operation. The plenum is preferably connected via feed ducts to a main plenum, which supplies the blade with cooling air. No direct connection to the cooling-medium supply is therefore necessary, with the result that the manufacturing costs can be reduced.

Although the above-described cooling concept can be implemented for use in any desired components subjected to high thermal loads, it is employed preferably on overhangs of turbine blades. The overhangs of turbine blades experience particularly high thermal loads, and a coolant supply is usually provided in the immediate vicinity of the overhang, with the result that the cooling concept according to the invention can be implemented in a particularly simple way.

BRIEF DESCRIPTION OF THE DRAWINGS

Exemplary embodiments of the invention are illustrated diagrammatically in the following figures, in which.

DESCRIPTION OF THE PREFERRED EMBODIMENTS

The concept of the invention is explained with reference to a platelike projecting component portion in the form of an overhang 1 which is formed as an integral part of a platform 3 having a turbine blade 4. In this case, a surface 2 is subjected to high thermal loads, such as by a hot-gas jet, which is not illustrated.

Figure 1:
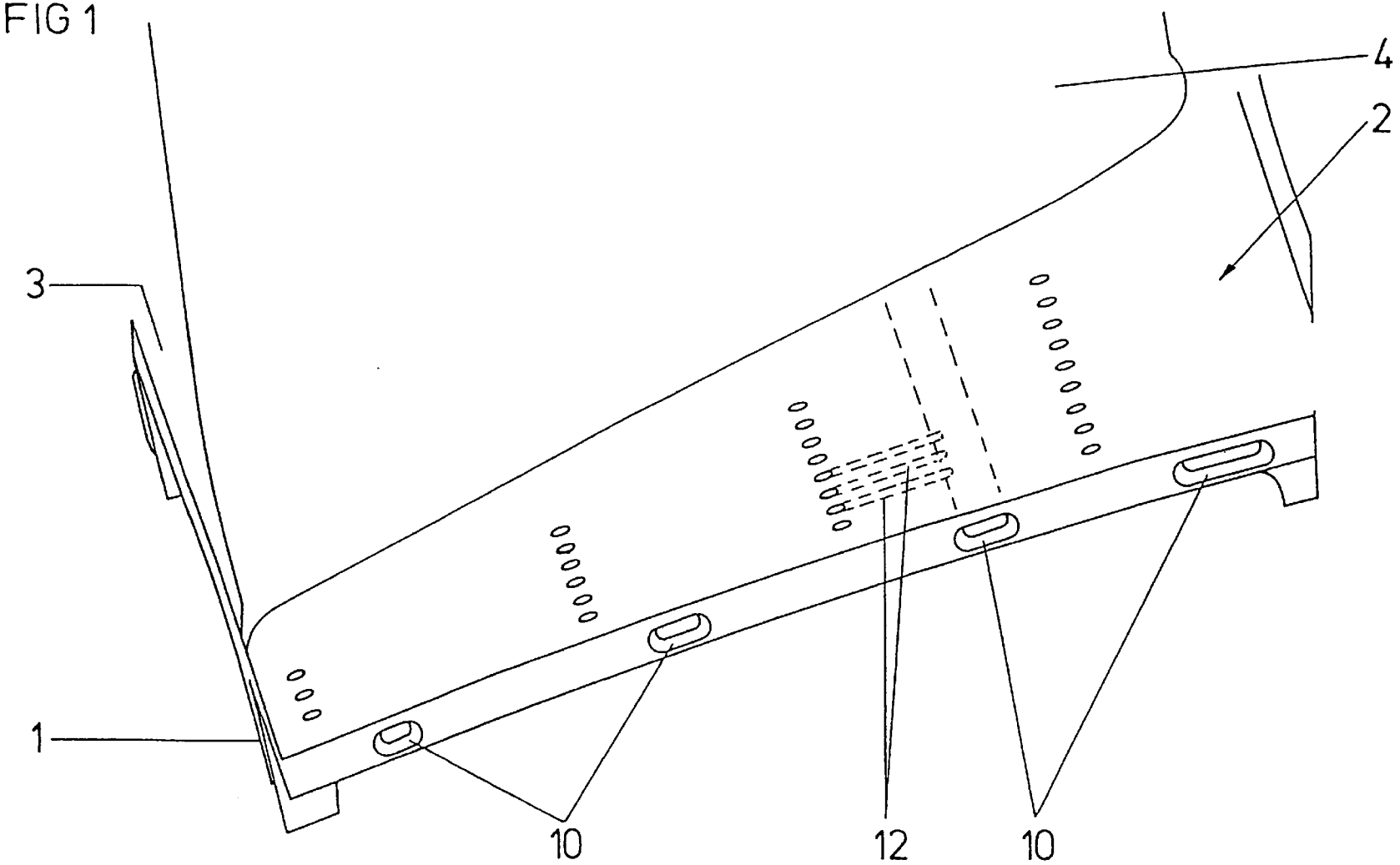
FIG. 1 shows a perspective view from above an overhang on a turbine blade.
Figure 2:
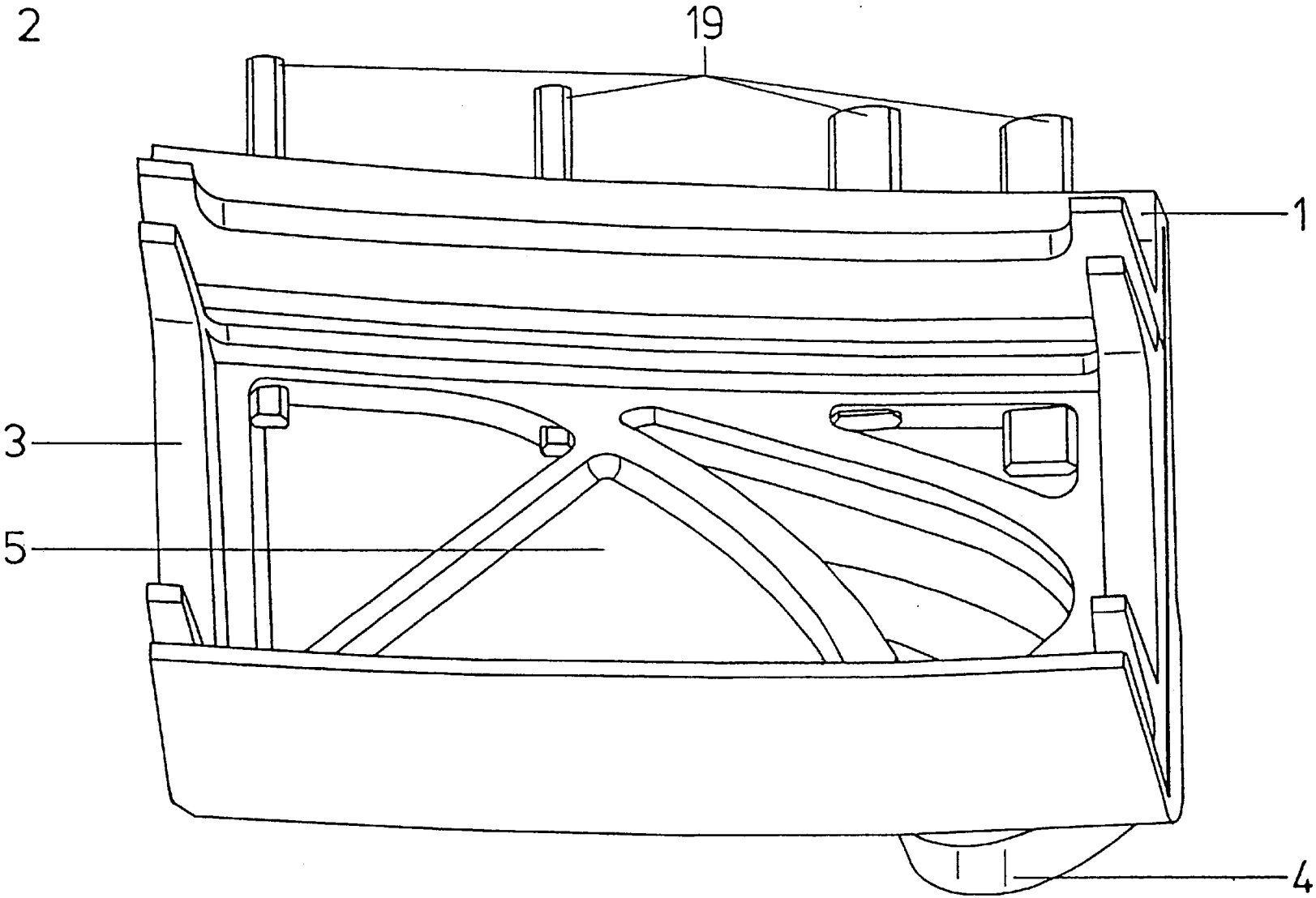
FIG. 2 shows a view from below the overhang shown in FIG. 1.

In the exemplary embodiment illustrated in FIG. 1 and FIG. 2, four plenums 10 are arranged on overhang 1 essentially parallel to and at a distance from one another, and passing continuously through the overhang 1. The plenums 10 run directly adjacent to the surface 2 and cool the surface 2 in this region by means of a cooling medium which passes through the plenums and provides convective heat transfer. Blow-out orifices 12 can be connected to the plenums 10, and are preferably arranged in rows as shown in FIG. 1. The blow out orifices emanate from the plenums 10 and extend to the surface 2 so as to issue the cooling medium onto the surface 2. Cooling medium is blown out of the plenums 10 and through the blow-out orifices 12, in such a way that a coherent cooling film is formed. The surface 2 is thus cooled optimally.

As shown in FIG. 2, the plenums 10 may be formed by Electrical Discharge Machining (EDM) tools 19 which can be used to drill passage orifices into the overhang 1. A connection is thus made with a main plenum 5 below the platform 3, with the result that the plenums 10 are fed with cooling air from this region.

Depending on the requirements for a particular application, the plenums 10 may extend laterally in the overhang 1 and be provided with openings at a lateral edge of the overhang 1, as illustrated in FIG. 1. In this case, cooling air is additionally blown out of the overhang 1 in a lateral direction. It is equally possible, however, to close the plenums 10 partially or completely in this region.

The cross section of the individual plenums 10 may vary, in order to achieve a cooling effect coordinated with the local heat load. This also applies with regard to the number of plenums, and the distribution and arrangement of the plenums along the overhang 1. Similarly, the number of cooling bores or blow-out orifices 12, and their distribution and arrangement can be varied to achieve the desired cooling film over the surface 2 and the desired cooling effect.

Figure 3:
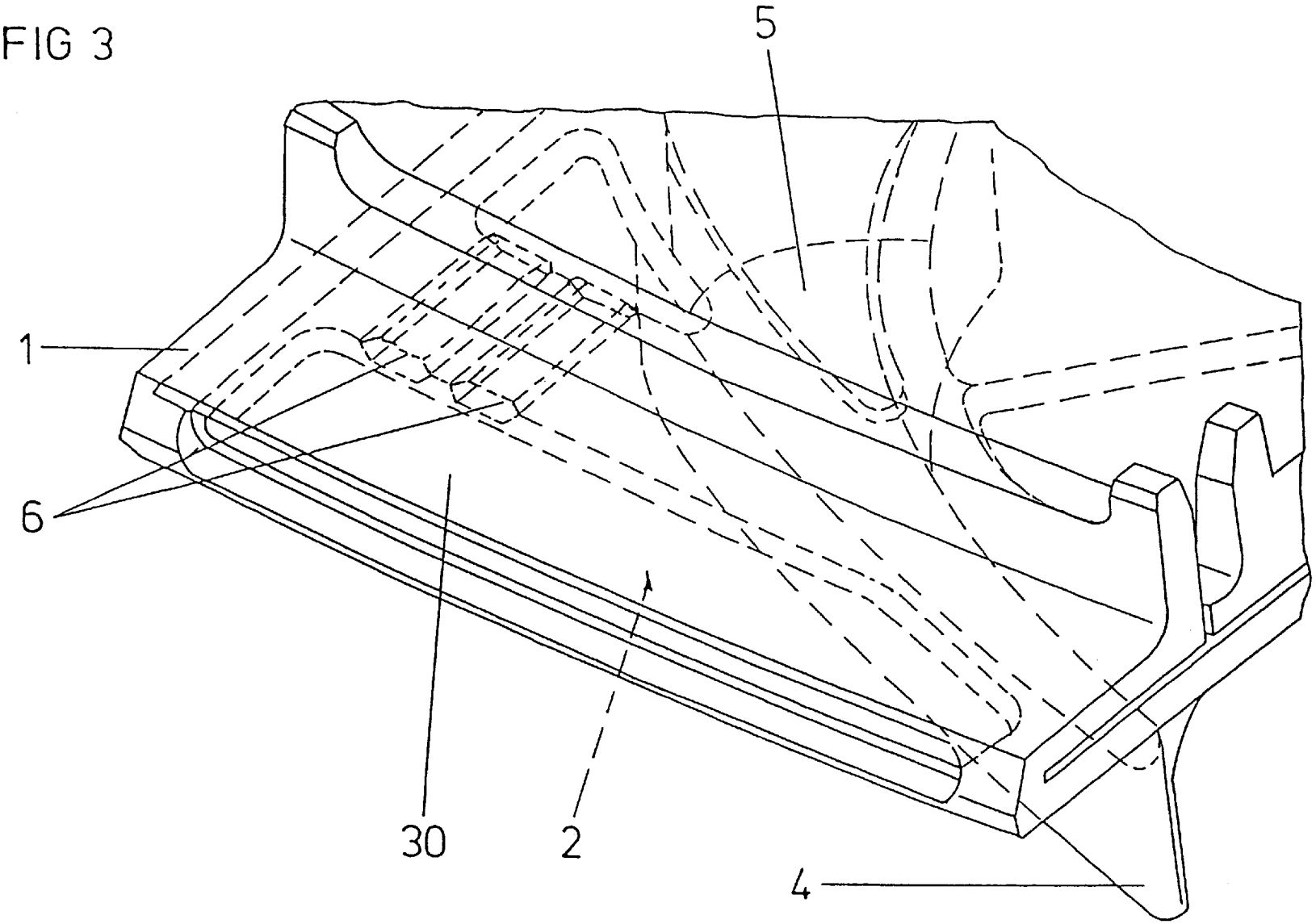
FIG. 3 shows a view from below an overhang on a turbine blade according to a first embodiment of the invention.

The embodiment illustrated in FIG. 3 shows a plenum 30 which passes continuously, and essentially completely, through the overhang 1 in the longitudinal and transverse directions. This embodiment allows for a substantially equal convective cooling across the entire surface 2 and, furthermore, affords the possibility of arranging the film-cooling air bores (not illustrated) in any desired configuration. The plenum 30 is supplied from the main plenum 5 through feed ducts 6, which make the connection between the main plenum 5 and the plenum 30.

Figure 4:
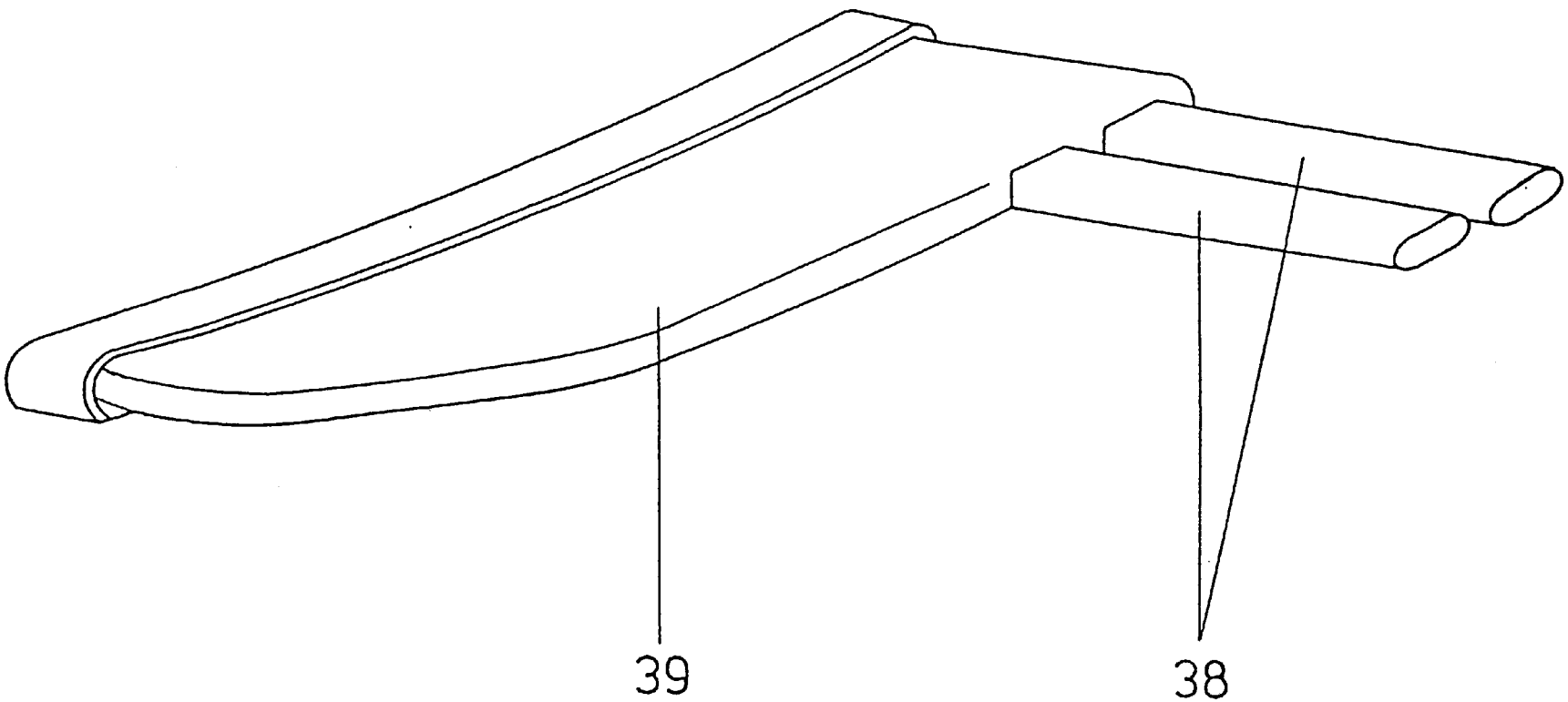
FIG. 4 shows a core for producing a plenum.

In the embodiment shown in FIG. 3, the plenum 30 and the feed ducts 6 can be formed directly during the casting operation. For this purpose, a core 39, illustrated in FIG. 4, is used, which predetermines the shape of the plenum 30. Furthermore, two feed-duct portions 38 are provided, in order to form the feed ducts 6. With the aid of this multipart core 38, 39, the plenum 30, including the feed ducts 6, can be formed in a simple way.

Figure 5:
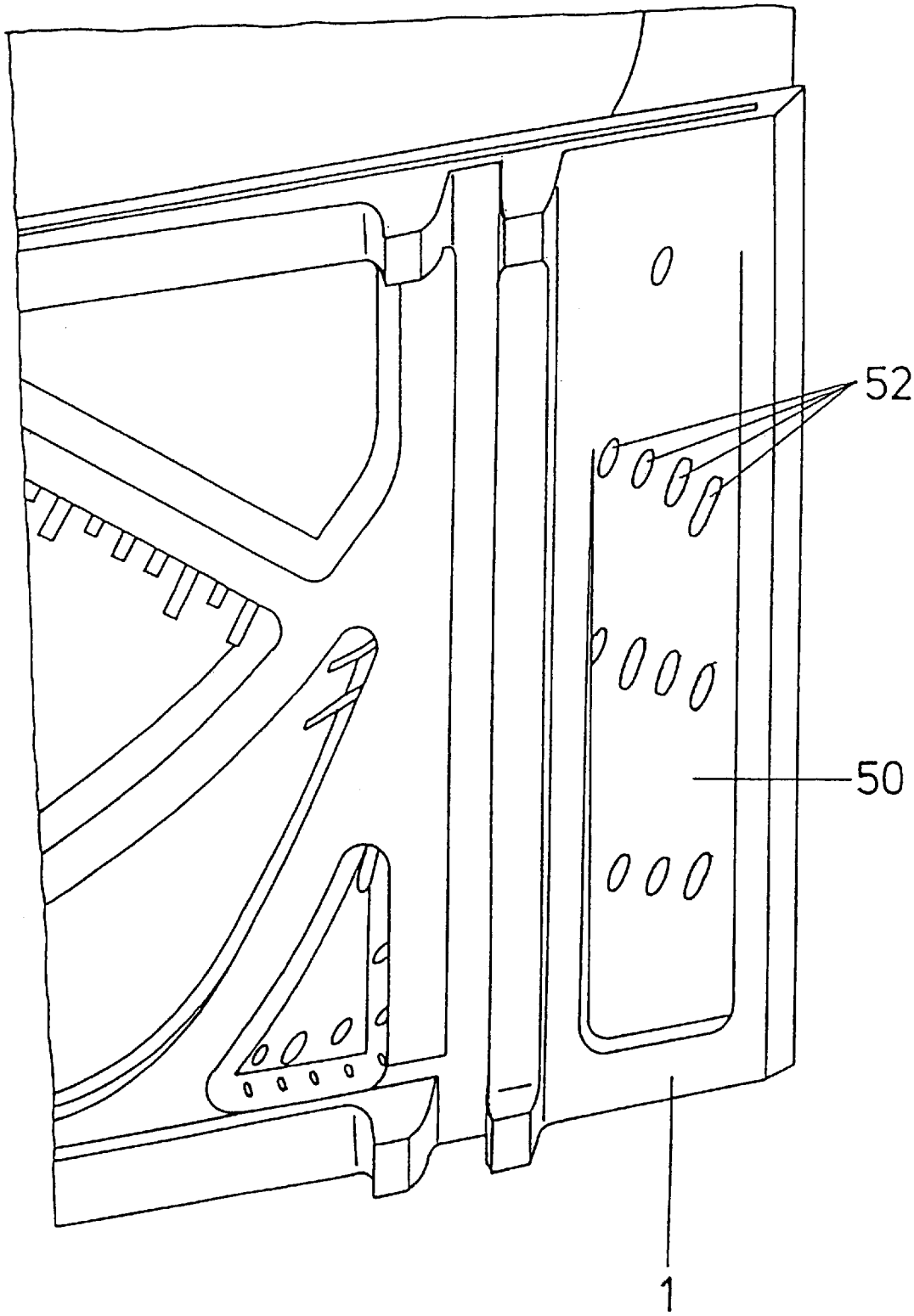
FIG. 5 shows a view from below an overhang on a turbine blade according to a second embodiment of the invention.

The embodiment illustrated in FIG. 5 shows a cavity 50 which is cast in the overhang 1 and from which the cooling bores 52 emanate. The actual plenum is formed when the cavity 50 is closed by means of a cover which is not illustrated here. The cover may consist of a simple plate which is placed on to the overhang 1 and is soldered or welded in place. Complicated geometries can thus be implemented by means of a corresponding configuration of the cavity 50. Such geometries may be, for example, pins, ribs or turbulence generators (not illustrated) which are arranged on the surface 2.

The above-described concepts are not only restricted to use on overhangs for turbine blades, but can also be used wherever platelike projecting component portions are exposed to high thermal loads and must therefore be cooled effectively.

What is claimed is:

1. A platelike projecting component portion of a component for use in a gas turbine or other high temperature application, said component portion comprising:

a surface upon which hot gas acts, and including cooling bores through which a cooling medium is capable of flowing, at least one plenum assigned solely to the component portion, said at least one plenum being arranged directly adjacent to the surface upon which hot gas acts, and providing a passageway through which the cooling medium is capable of flowing and providing convective heat transfer, and wherein the at least one plenum passes through substantially all of the component portion; and the cooling bores forming blow-out orifices which emanate from the at least one plenum and which open onto the surface upon which hot gas acts, such that the cooling medium flowing from the at least one plenum and through the cooling bores forms a cooling film on the surface.

2. The component portion as claimed in claim 1, wherein the at least one plenum is formed by a casting method.

3. The component portion as claimed in claim 2, wherein the at least one plenum is formed by a multipart core.

4. The component portion as claimed in claim 1, wherein the at least one plenum is formed by a cavity which extends into the component portion and which is closed by a cover.

5. The component portion as claimed in claim 4, wherein the cover is soldered or welded to the component portion.

6. The component portion as claimed in claim 1, wherein at least one of the at least one plenum and the blow-out orifices is produced by the EDM method.

7. The component portion as claimed in claim 1, wherein the at least one plenum is connected to a main plenum through feed ducts.

8. The component portion as claimed in claim 1, wherein the component portion forms an overhang on a turbine blade.

* * * * *